US006623438B1

(12) United States Patent
Wu

(10) Patent No.: US 6,623,438 B1
(45) Date of Patent: Sep. 23, 2003

(54) DEVICE FOR MASSAGING THE BACK OF THE HUMAN BODY

(76) Inventor: Dong-Her Wu, No. 141, Chang Shui Rd., Sec. 2, Pu Yen Hsiang, Chang Hua Hsien (TW)

( * ) Notice: Subject to any disclaimer, the term of this patent is extended or adjusted under 35 U.S.C. 154(b) by 0 days.

(21) Appl. No.: 10/134,861

(22) Filed: Apr. 30, 2002

(51) Int. Cl.[7] ..... A61H 15/00

(52) U.S. Cl. ..... 601/99; 601/100; 601/102; 601/103; 601/116

(58) Field of Search ..... 601/89, 90, 93, 601/94, 97, 98, 99, 100–103, 107, 108, 111, 115, 116

(56) References Cited

U.S. PATENT DOCUMENTS 5,755,677 A * 5/1998 Masuda et al. ..... 601/99
6,039,705 A * 3/2000 Wu ..... 601/99
6,071,252 A * 6/2000 Marcantoni ..... 601/115
6,196,983 B1 * 3/2001 Wu ..... 601/99
6,551,259 B1 * 4/2003 Wu ..... 601/99

* cited by examiner

*Primary Examiner*—Danton D. DeMille
*Assistant Examiner*—Quang D Thanh
(74) *Attorney, Agent, or Firm*—Harrison & Egbert

(57) ABSTRACT

A device is used to massage the back of a person seated on a chair. The device includes a base, a motor, a transmission member, and a slide seat. The device is used such that the base is rested against the backrest of the chair. The motor, the transmission member, and the slide seat are mounted on one side of the base such that the slide seat is driven by the transmission member to move back and forth on the base. The slide seat is provided with a front swing rod, a rear swing rod, a front roller set pivoted with the front swing rod, and a rear roller set pivoted with the rear swing rod. The roller sets are carried by the slide seat in motion to move over the back of the person with pressure and friction.

2 Claims, 8 Drawing Sheets

FIG. 1 · PRIOR ART

DEVICE FOR MASSAGING THE BACK OF THE HUMAN BODY

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a massaging device, and more particularly to a massaging device which is designed to knead the muscles in a stiff back, so as to make the muscles supple.

BACKGROUND OF THE INVENTION

As shown in FIGS. 1 and 2, a massaging device of the prior art is used to massage the muscles in a stiff back and is formed of a base 11, a transmission rod 13, a sliding seat 16, and a plurality of massaging rollers 18. The base 11 is provided with a pad 10. The transmission rod 13 has outer threads 12 and is pivoted with the base 11. The transmission rod 13 is driven by a motor 14 to actuate the sliding seat 16 to slide along a track 15. The rollers 18 are pivotally fastened with two roller frames 17 which are mounted on the sliding seat 16. As the sliding seat 16 is actuated by the transmission rod 13 to slide up and down, the massaging rollers 18 move along to rub back muscles of the human body.

Such a prior art massaging device as described above is defective in design because the roller frame 17 is balanced on a support at the middle such that when the massaging rollers 18 at one end go up, the massaging rollers 18 at the other end comes down. Such an up-and-down movement of the massaging rollers 18 does not bring about an effective action of massaging the back muscles. In addition, the massaging rollers 18 are driven to move along the curved surface of the back of the human body, without pressure and friction. As a result, the action of the massaging rollers 18 is not effective in making the stiff back muscles supple. Moreover, the moving path of the massaging rollers 18 does not conform to the curvature of the back.

BRIEF SUMMARY OF THE INVENTION

The primary objective of the present invention is to provide a device capable of massaging effectively the muscles in a stiff back.

In keeping with the principle of the present invention, the foregoing objective of the present invention is attained by a massaging device comprising a base, a transmission member, a driving member, a slide seat, and a plurality of roller sets. The slide seat is actuated by the transmission member to move up and down along a track of the base. The slide seat is provided in two opposite sides thereof with a swivel rod pivoted therewith. The roller sets are pivotally mounted on two longitudinal ends of the swivel rod. The swivel rod is provided at the middle with a movable joint and is divided into a front swing rod and a rear swing rod, which are capable of swiveling independently. As the front swing rod and the rear swing rod move along a curved surface of the track, the rollers move over the back muscles with pressure and friction.

The features and the advantages of the present invention will be more readily understood upon a thoughtful deliberation of the following detailed description of the present invention with reference to the accompanying drawings.

DETAILED DESCRIPTION OF THE INVENTION

Figure 1:
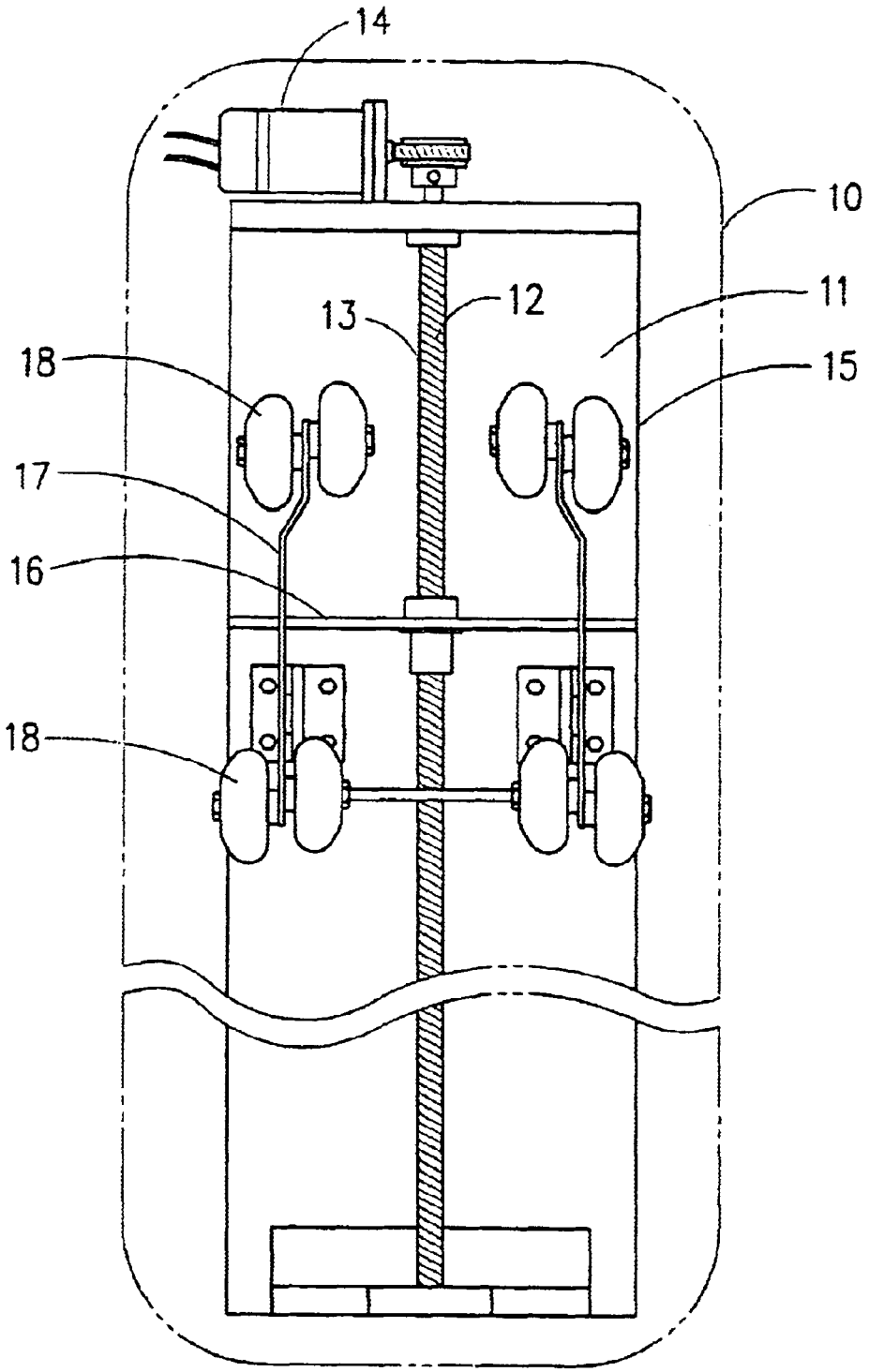
FIG. 1 shows a front plan view of a back massaging device of the prior art.
Figure 2:
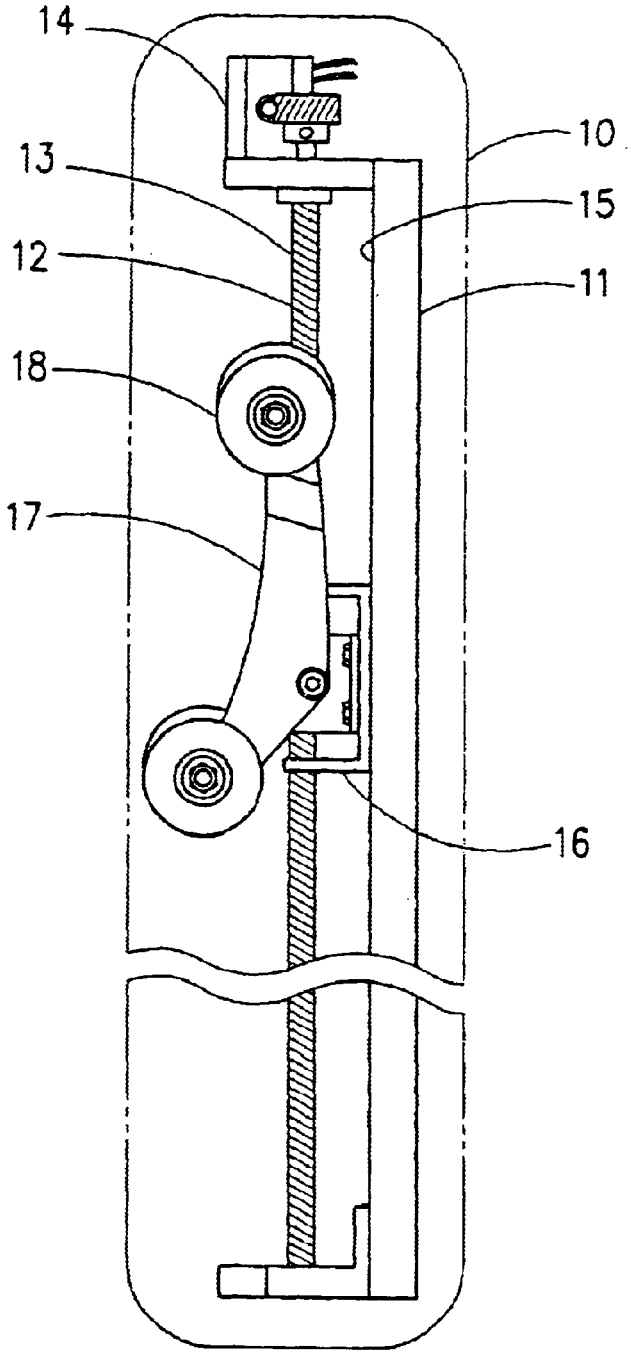
FIG. 2 PRIOR ART
FIG. 2 shows a side plan view of the prior art device as shown in FIG. 1.
Figure 3:
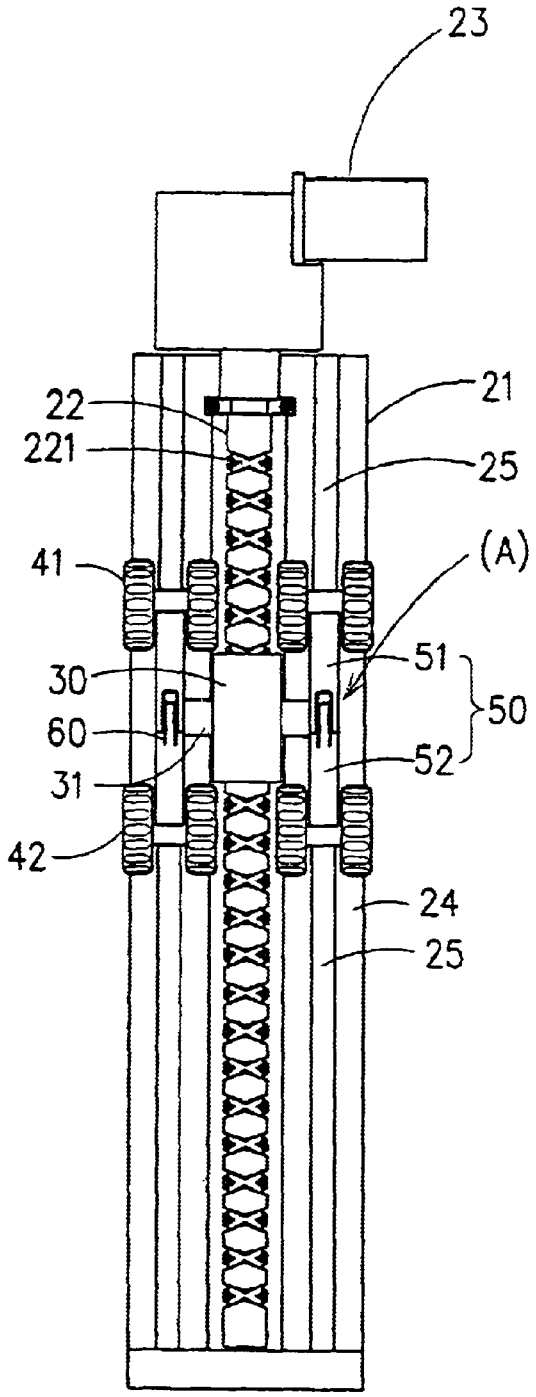
FIG. 3 shows a schematic plan view of the present invention.
Figure 4:
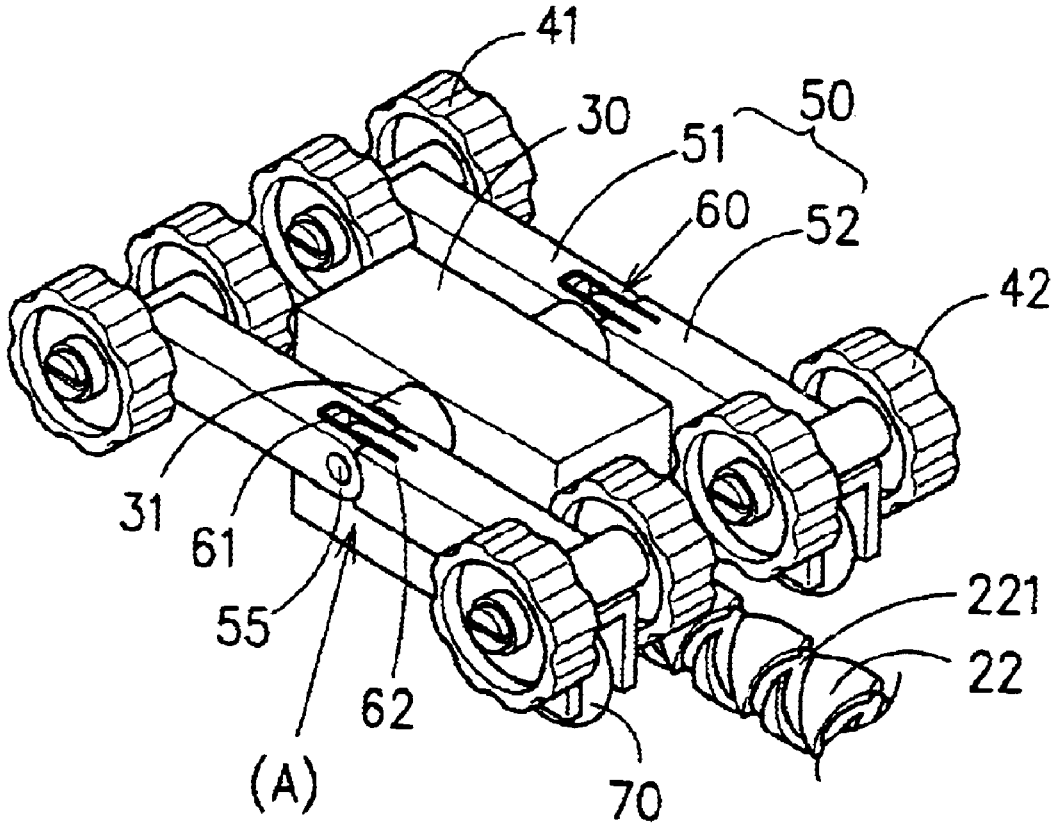
FIG. 4 shows a partial perspective view of the present invention.
Figure 5:
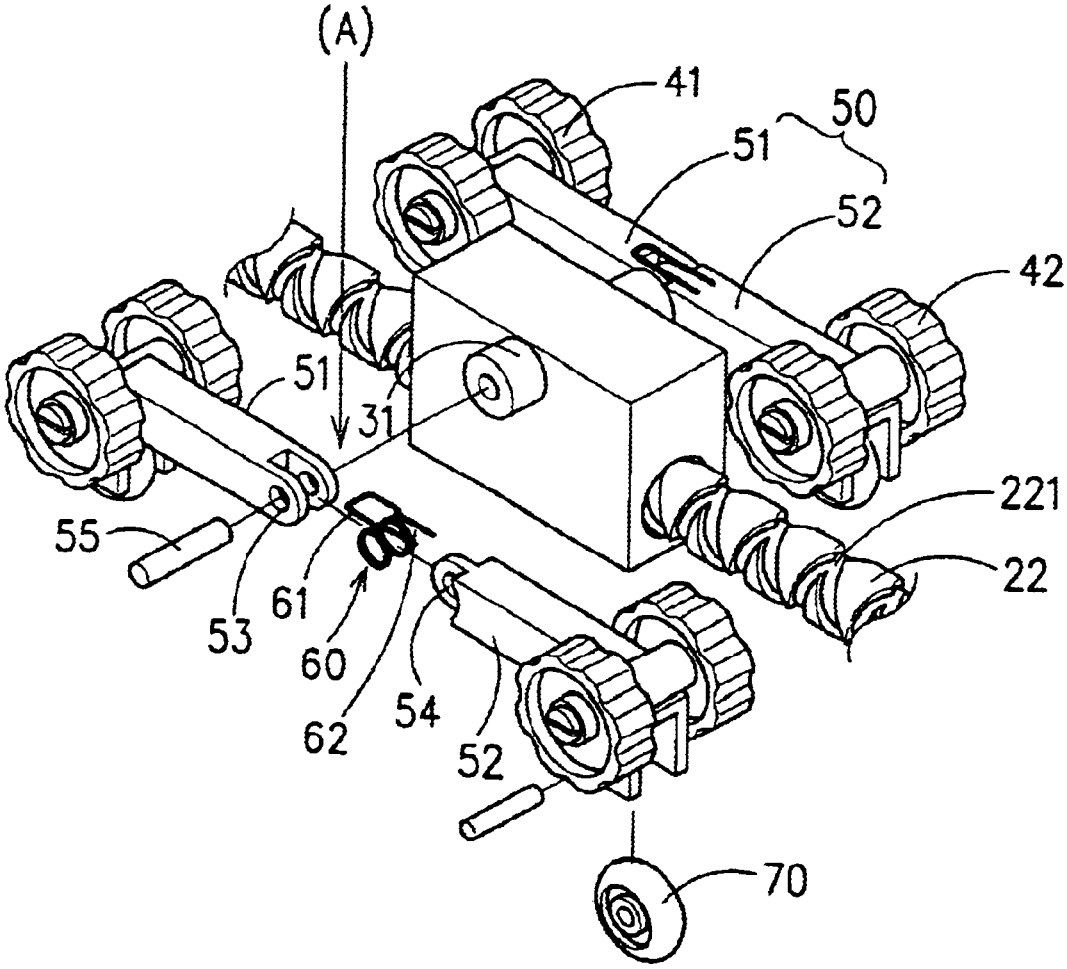
FIG. 5 shows a partial exploded sectional view of the present invention.

As shown in FIGS. 3–7, a massaging device embodied in the present invention is designed for use in conjunction with a chair backrest 80 and is formed of a base 21, a transmission member 22, a motor 23, a slide seat 30, and a plurality of roller sets 41 and 42.

Figure 6:
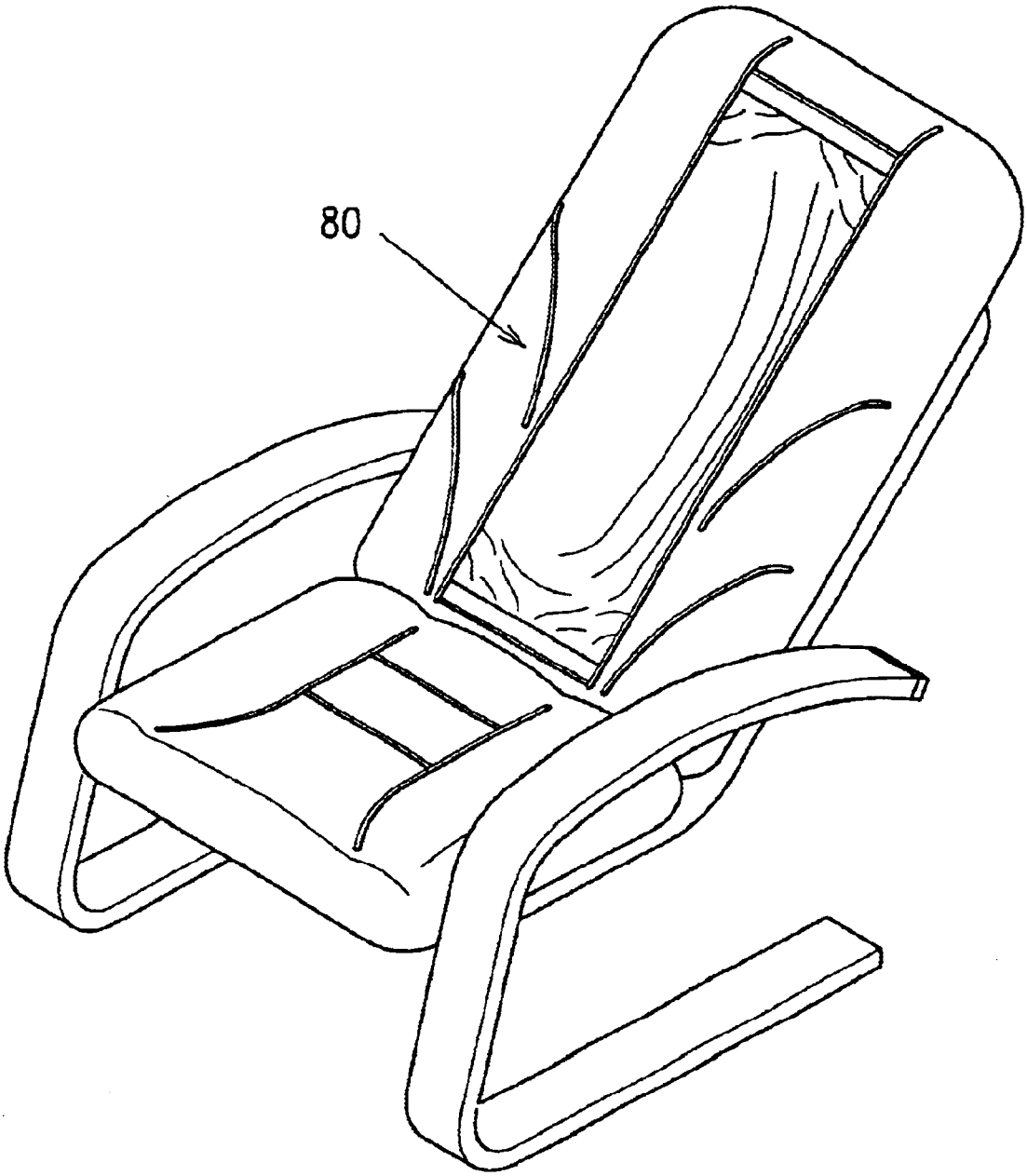
FIG. 6 shows a schematic view of the present invention in use along with a chair.
Figure 7:
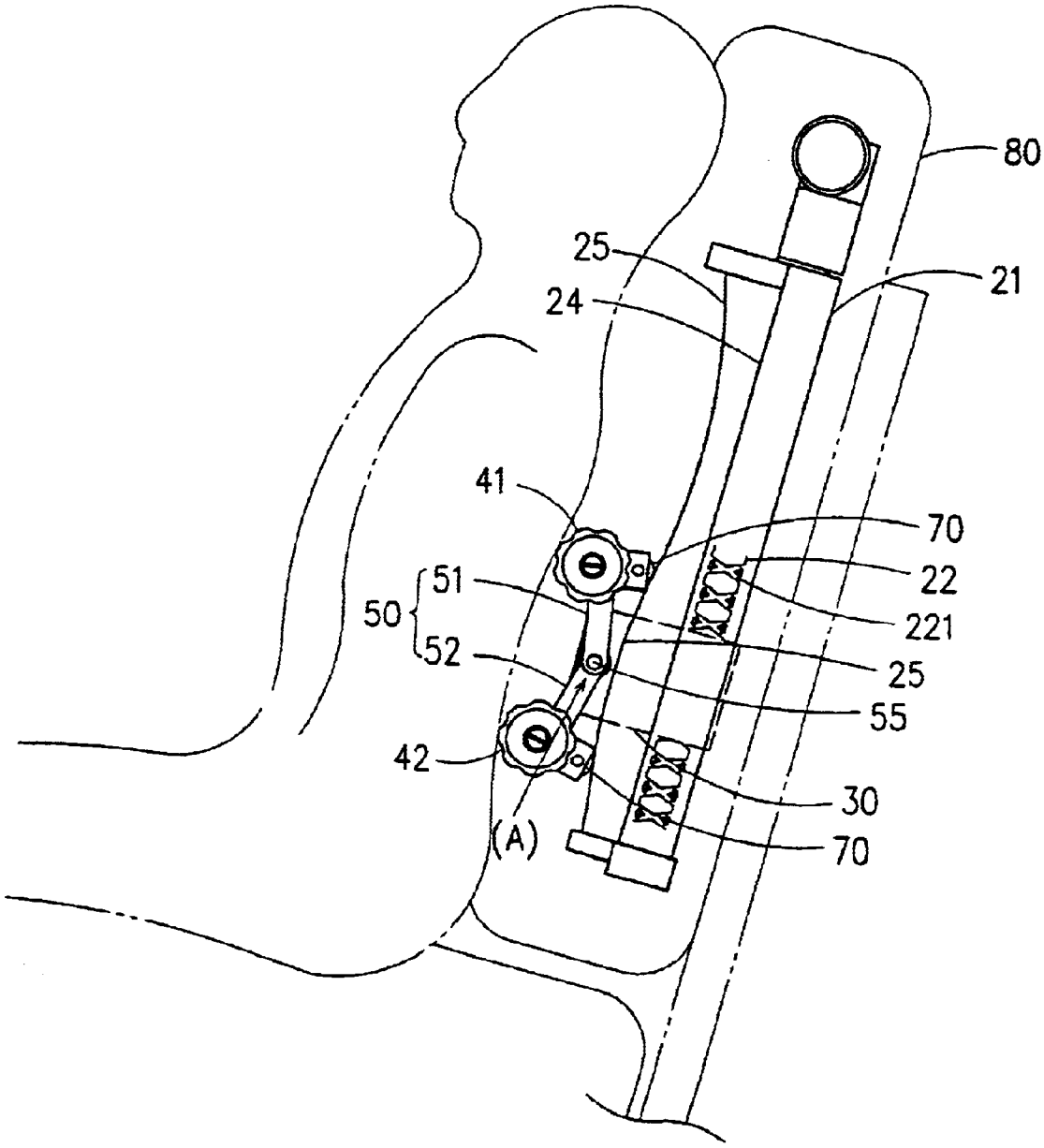
FIG. 7 shows a side schematic view of the present invention as shown in FIG. 6.

The transmission member 22, the motor 23, the slide seat 30, and the roller sets 41 and 42 are all mounted on one side of the base 21. When the device of the present invention is in use in conjunction with a chair, the other side of the base 21 rests against the backrest 80 of the chair, as shown in FIGS. 6 and 7.

Figure 8:
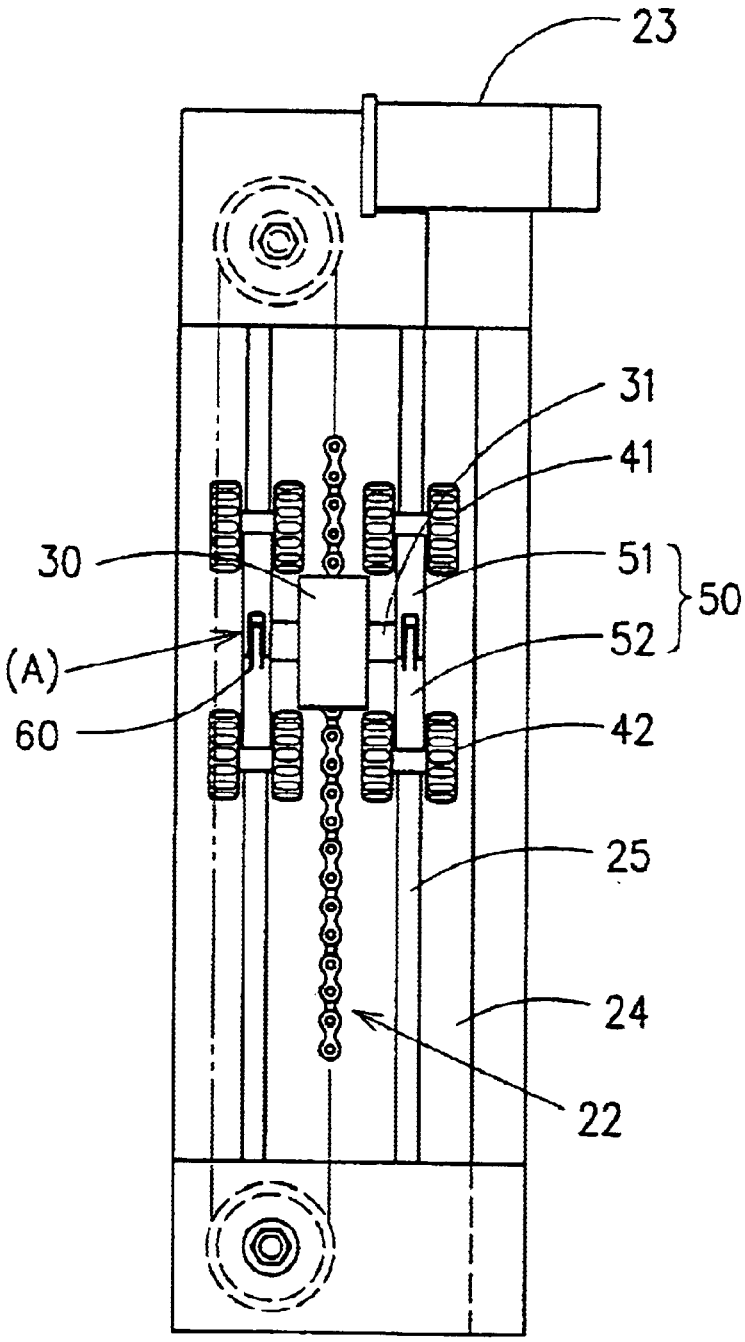
FIG. 8 shows a schematic view of a chain serving as the transmission member of the present invention.

The transmission member 22 is a transmission rod with threads 221. The threaded transmission rod 22 may by replaced by a chain, as shown in FIG. 8. The transmission member 22 is driven by the motor 23. The slide seat 30 is driven by the transmission member 22 to slide back and forth along two tracks 24 of the one side of the base 21. The slide seat 30 is provided with two shafts 31 opposite in location to each other, and two swivel rods 50 which are pivotally fastened with the two shafts 31. The two roller sets 41 and 42 are pivoted to two longitudinal ends of each of the two swivel rods 50.

The present invention is characterized by the swivel rods 50, each being provided at a midsegment with a movable joint "A" which divides the swivel rod 50 into a front swing rod 51 and a rear swing rod 52. The front swing rod 51 is provided at one end with a pivoting hole 53, whereas the rear swing rod 52 is provided at one end with a pivoting hole 54. The front swing rod 51 and the rear swing rod 52 are jointly pivoted with the shaft 31 of the slide seat 30 by a pivot 55 which is put through the pivoting holes 53 and 54 in conjunction with a recovery element 60. The recovery element 60 has one end 61 urging one end of the front swing rod 51, and other end 62 urging one end of the rear swing rod 52. The recovery element 60 serves to provided the front swing rod 51 and the rear swing rod 52 with a recovery force. The recovery element 60 of the present invention is a torsion spring.

The first roller set 41 is pivoted with other end of the front swing rod 51, whereas the second roller set 42 is pivoted with other end of the rear swing rod 52. The front swing rod 51 is provided in the underside of the other end thereof with a sliding wheel 70. Similarly the rear swing rod 52 is provided in the underside of the other end thereof with a sliding wheel 70. In operation, the sliding wheels 70 of the front and the rear swing rods 51 and 52 move along a curved surface 25 of the track 24 of the base 21, as shown in FIG. 7. In the meantime, roller sets 41 and 42 come in contact with back of a person with pressure and friction so as to soothe the back muscles of the person. When the device of the present invention is in action, the front swing rod 51 and the rear swing rod 52 can swivel independently on the pivot 55. The curved surface 25 of the tracks 24 of the base 21 has a curvature in harmony with the back curvature of the human body.

We claim:

1. A device for massaging a back of a person seated on a chair, said device comprising:

a base, in one side, comprised of two tracks and, in another side thereof rested against a backrest of the chair at the time when said device is in use to massage the back of the person seated on the chair;

a motor mounted on the one side of said base;

a transmission member mounted on the one side of said base such that said transmission member is driven by said motor; and a slide seat mounted on the one side of said base such that said slide seat is driven by said transmission member to run back and forth along said tracks of said base, said slide seat being comprised of two shafts opposite to each other and two swivel rods, each being pivoted to said shafts of said slide seat and being comprised of two roller sets which are pivotally fastened to two longitudinal ends of said swivel rod;

wherein said tracks of said base are comprised of a curved surface;

wherein each of said two swivel rods is comprised of a front swing rod and a rear swing rod, which are jointly pivoted at one end with one of said two shafts of said slide seat by a pivot in conjunction with a recovery element whereby said recovery element urges at one end thereof the one end of said front swing rod, and at another end thereof the one end of said rear swing rod, with one of said two roller sets being pivoted with the other end of said front swing rod, with another one of said two roller sets being pivoted with the other end of said rear swing rod, said front swing rod and said rear swing rod being comprised of, in an underside of the other end thereof, a sliding wheel whereby said sliding wheel is caused by said slide seat in motion to run back and forth on said curved surface of said tracks of said base, along with said roller sets moving over the back of the person with pressure and friction.

2. The device as defined in claim 1, wherein said recovery element comprises a torsion spring.

* * * * *